US007785184B2

(12) United States Patent
Jubinville et al.

(10) Patent No.: US 7,785,184 B2
(45) **Date of Patent: *Aug. 31, 2010**

(54) COMPUTER-IMPLEMENTED SIMULATED CARD GAME

(75) Inventors: Chantal Jubinville, Hoboken, NJ (US); Stephen Gerard Penrice, Morristown, NJ (US); Alan Kyle Bozeman, Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/088,166

(22) Filed: Mar. 23, 2005

(65) Prior Publication Data

US 2006/0217167 A1 Sep. 28, 2006

(51) Int. Cl.
*A63F 1/00* (2006.01)
*A63F 9/00* (2006.01)

(52) U.S. Cl. ..... 463/13; 463/17; 273/292

(58) Field of Classification Search ..... 463/13, 463/11, 25, 26, 17; 273/292
See application file for complete search history.

(56) References Cited

U.S. PATENT DOCUMENTS

| | | | | |
|---|---|---|---|---|
| 1,527,929 | A | 2/1925 | Simons | |
| 3,505,646 | A | 4/1970 | Affel, Jr. et al. | |
| 3,826,499 | A | 7/1974 | Lenkoff | |
| 4,491,319 | A | 1/1985 | Nelson | |
| 4,634,149 | A | 1/1987 | Donovan | |
| 4,740,016 | A | 4/1988 | Konecny et al. | |
| 4,856,787 | A | 8/1989 | Itkis | |
| 4,943,090 | A | 7/1990 | Fienberg | |
| 5,037,099 | A | 8/1991 | Burtch | |
| 5,046,736 | A * | 9/1991 | Bridgeman et al. | 463/13 |
| 5,046,737 | A | 9/1991 | Fienberg | |
| 5,092,598 | A | 3/1992 | Kamille | |
| 5,118,109 | A | 6/1992 | Gumina | |
| 5,356,140 | A * | 10/1994 | Dabrowski et al. | 463/12 |
| 5,382,025 | A | 1/1995 | Sklansky et al. | |
| 5,390,934 | A | 2/1995 | Grassa | |
| 5,401,023 | A * | 3/1995 | Wood | 463/13 |
| 5,407,199 | A | 4/1995 | Gumina | |
| 5,437,451 | A * | 8/1995 | Fulton | 463/13 |

(Continued)

FOREIGN PATENT DOCUMENTS

| | | |
|---|---|---|
| GB | 2 071 369 | 9/1981 |

(Continued)

OTHER PUBLICATIONS

World Series of Poker (2003), 4 pages, first accessed Oct. 27, 2007, <http://www.youtube.com/watch?v=y1q-bpGw-8k>.*

(Continued)

*Primary Examiner*—Scott Jones
*Assistant Examiner*—William H McCulloch
(74) *Attorney, Agent, or Firm*—Dority & Manning, P.A.

(57) ABSTRACT

A monitor-based Texas Hold'em Poker game, where a plurality of game entries are displayed to a player and each game entry is associated with a winning odds and potential payout. After the player places a wager on one of the game entries, the system generates a set of community cards and determines a winning hand according to a set of predefined rules.

15 Claims, 10 Drawing Sheets

U.S. PATENT DOCUMENTS

| | | | | |
|---|---|---|---|---|
| 5,630,753 | A * | 5/1997 | Fuchs | 463/9 |
| 5,636,843 | A * | 6/1997 | Roberts | 273/292 |
| 5,664,781 | A | 9/1997 | Feola | |
| 5,669,817 | A * | 9/1997 | Tarantino | 463/13 |
| 5,755,621 | A * | 5/1998 | Marks et al. | 463/42 |
| 5,816,915 | A * | 10/1998 | Kadlic | 463/13 |
| 5,823,873 | A * | 10/1998 | Moody | 463/13 |
| 5,839,731 | A | 11/1998 | Feola | |
| 5,868,392 | A | 2/1999 | Kraft | |
| 5,967,894 | A * | 10/1999 | Kinoshita et al. | 463/13 |
| 5,984,779 | A * | 11/1999 | Bridgeman et al. | 463/16 |
| 6,102,400 | A * | 8/2000 | Scott et al. | 273/269 |
| 6,132,311 | A * | 10/2000 | Williams | 463/13 |
| 6,196,547 | B1 * | 3/2001 | Pascal et al. | 273/292 |
| 6,206,373 | B1 * | 3/2001 | Garrod | 273/292 |
| 6,358,144 | B1 * | 3/2002 | Kadlic et al. | 463/13 |
| 6,379,245 | B2 * | 4/2002 | De Keller | 463/13 |
| 6,435,500 | B2 * | 8/2002 | Gumina | 273/139 |
| 6,511,068 | B1 * | 1/2003 | Sklansky et al. | 273/237 |
| 6,561,897 | B1 * | 5/2003 | Bourbour et al. | 463/13 |
| 6,572,470 | B1 * | 6/2003 | Famularo | 463/13 |
| 6,637,747 | B1 * | 10/2003 | Garrod | 273/292 |
| 6,651,983 | B1 * | 11/2003 | Chobanian | 273/292 |
| 6,695,695 | B2 * | 2/2004 | Angel | 463/13 |
| 6,729,959 | B1 * | 5/2004 | Moore et al. | 463/30 |
| 6,780,104 | B2 * | 8/2004 | Fox | 463/13 |
| 6,855,053 | B2 * | 2/2005 | Baerlocher | 463/16 |
| 6,877,745 | B1 * | 4/2005 | Walker et al. | 273/292 |
| 6,929,546 | B2 * | 8/2005 | Moore et al. | 463/30 |
| 6,932,707 | B2 * | 8/2005 | Duhamel | 463/42 |
| 7,008,319 | B2 * | 3/2006 | Montgomery et al. | 463/21 |
| 7,029,395 | B1 * | 4/2006 | Baerlocher | 463/20 |
| 7,044,468 | B2 * | 5/2006 | Sklansky et al. | 273/292 |
| 7,048,629 | B2 * | 5/2006 | Sines et al. | 463/16 |
| 7,223,171 | B2 * | 5/2007 | Colin et al. | 463/11 |
| 7,396,015 | B2 * | 7/2008 | Feola | 273/292 |
| 7,410,417 | B2 * | 8/2008 | Feola | 463/13 |
| 7,413,509 | B2 * | 8/2008 | Sklansky et al. | 463/13 |
| 7,427,067 | B2 * | 9/2008 | Feola | 273/292 |
| 7,438,293 | B2 * | 10/2008 | Sklansky et al. | 273/274 |
| 7,451,987 | B1 * | 11/2008 | Feola | 273/292 |
| 7,464,936 | B2 * | 12/2008 | Feola | 273/292 |
| 7,481,432 | B2 * | 1/2009 | Feola | 273/139 |
| 7,481,434 | B1 * | 1/2009 | Feola | 273/292 |
| 7,581,732 | B2 * | 9/2009 | Feola | 273/292 |
| 7,654,532 | B2 * | 2/2010 | Feola | 273/292 |
| 2002/0151348 | A1 | 10/2002 | Burns et al. | |
| 2003/0100357 | A1 * | 5/2003 | Walker et al. | 463/16 |
| 2004/0135316 | A1 * | 7/2004 | Lipscomb | 273/274 |
| 2004/0204213 | A1 * | 10/2004 | Schugar et al. | 463/6 |
| 2005/0059452 | A1 * | 3/2005 | Hartl | 463/13 |
| 2005/0288081 | A1 * | 12/2005 | Amaitis et al. | 463/6 |
| 2006/0003829 | A1 * | 1/2006 | Thomas | 463/20 |
| 2006/0154715 | A1 * | 7/2006 | Black et al. | 463/13 |
| 2006/0273156 | A1 | 12/2006 | Berm et al. | |
| 2007/0026916 | A1 * | 2/2007 | Juds et al. | 463/1 |
| 2007/0135195 | A1 * | 6/2007 | Albino | 463/13 |
| 2007/0135950 | A1 * | 6/2007 | Oliveras | 700/91 |
| 2007/0213124 | A1 * | 9/2007 | Walker et al. | 463/25 |
| 2007/0225056 | A1 * | 9/2007 | Lewis et al. | 463/13 |

FOREIGN PATENT DOCUMENTS

| | | |
|---|---|---|
| GB | 2 075 918 | 11/1981 |
| WO | WO 95/10098 | 4/1995 |
| WO | WO 01/05474 | 1/2001 |
| WO | WO 01/42968 | 6/2001 |

OTHER PUBLICATIONS

EP Search Report, Apr. 15, 2010.

* cited by examiner

COMPUTER-IMPLEMENTED SIMULATED CARD GAME

BACKGROUND OF THE INVENTION

1. Field of the Invention

The present invention generally relates to game of chance and, more specifically, to a computer-implemented card game that generally simulates Texas Hold'em Poker.

2. Description of the Related Art

Computerized gambling, lottery games and instant games, whether run by governmental or private entities, have proven to be quite popular, and go back some time in history. Participation in a game gives a person a chance to win a substantial amount of money while also allowing private parties and lottery authorities to collect monies, some of them for public or charitable purposes. When taxed, the sales from games also provide additional revenue to state and city governments.

As technology advances, many games are ported from a paper-ticket based environment to a computer-based environment. Implementing games in a computer-based environment makes administration of games easier. Casino owners and/or government authorities can obtain almost instantaneously sales information from the gaming machines. However, implementing a traditional game in the computer-based environment is typically not a straightforward process. Many difficulties have to be overcome to preserve a game's characteristics that attract players in the first instance, and yet use the computer environment to make the game more player-friendly. One of the games that pose challenges to be ported to the computer-based environment is playing card games.

Accordingly, it is desirous to have a playing card game with a different strategic element present, such as Hold'em Poker available on a computer-based environment, where players can experience the excitement of this game along with additional information available in the computer-based environment that simplifies the game. It is thus to such a game that the present invention is primarily directed.

SUMMARY OF THE INVENTION

In one embodiment, the invention is a method for playing a game of chance simulating a playing card game on a computing device. The method includes displaying a plurality of game entries to a virtual game to a player and displaying the winning odds associated with each entry to the player. Each entry includes at least two game elements, and each game element is associated with a game value according to a game rule for the virtual game. The method further includes receiving a wager from the player, displaying a set of five game elements to the player, determining a winning entry from the plurality of entries according to a predefined rule, and determining a payout for the winning entry. The wager is associated with at least one of the plurality of entries.

In another embodiment, the invention is an apparatus for playing a virtual playing card game simulating Texas Hold'em Poker. The apparatus includes a controller, a display device, a player input device, and a ticket issuing device. The display device is in communication with the controller and capable of displaying a plurality of entries to a player, wherein each entry includes at least two game elements. Each game element is associated with a game value according to a game rule for the virtual game, and each entry is associated with winning odds. The player input device is also in communication with the controller and capable of receiving a player bet from the player and communicating the player bet to the controller. The player bet is associated with an entry.

The ticket issuing device also communicates with the controller and is capable of receiving ticket information from the controller and issuing a ticket to the player. The display device is further capable of receiving play information from the controller and displaying the play information to the player, and the controller is capable of determining a winning entry from the plurality of entries according to a predefined rule.

In yet another embodiment, the invention is a system for playing a virtual playing card game. The system includes a communication network, at least one gaming machine, and a server for hosting the virtual game. The gaming machine communicates with the server through the communication network. The gaming machine is capable of receiving game information from the server, displaying a plurality of game entries to a player, receiving a bet from the player and communicating the bet to the server, receiving ticket information from the server, issuing a ticket to the player, receiving a plurality of game elements from the server, displaying the play information to the player, and receiving winning information from the server. The bet is associated with a game entry, and each game entry includes at least two game elements. Each game element is associated with a game value according to a game rule for the virtual game, and each game entry is also associated and displayed with winning odds. The winning information is determined according to a predefined rule.

Other aspects and features of the invention will become apparent after review of the hereinafter set forth in the following Brief Description of the Drawings, Detailed Description of the Invention, and the Claims.

DETAILED DESCRIPTION OF THE INVENTION

The rules for the playing card game of Texas Hold'em Poker game are simple. A player makes his or her best poker hand out of seven cards, with two cards in the player's hand and the other five community cards on the table. Thus, all players still in the game use three or more of the community cards to make their best hands. The player with the strongest hand wins. The game stars with the dealer dealing two cards face down to each player, and a round of betting commences. After all bets, raises, and folds are completed, the first three community cards are dealt.

The first three community cards are turned up all at once and are called "the flop". The flop is often the turning point in the game, determining who will stick it out to see the last two cards. A round of betting occurs immediately after the flop. Most players fold here if the flop does not fit with their hand. The fourth community cards is called "the turn". As in previous plays, bets are placed. Finally, the fifth and final community card is turned over. This card is commonly called "the river". The last round of betting is complete then the players turn over their cards, and the player with the highest hand wins.

This invention is directed to a computer-based Texas Hold'em Poker game. Broadly speaking, the game consists of two stages. The first stage consists of determining and displaying the initial sets of two-card hands. The second stage consists of determining and displaying the community cards—the 5 cards shared by all of the players. A player can choose a set of a two-card hands from a plurality of sets, wherein each set's winning odds are displayed to the player. The winning odds can be updated during the course of the game. At the end of the game, if the player has the winning hand, the player wins a prize associated with the set selected.

Figure 1:
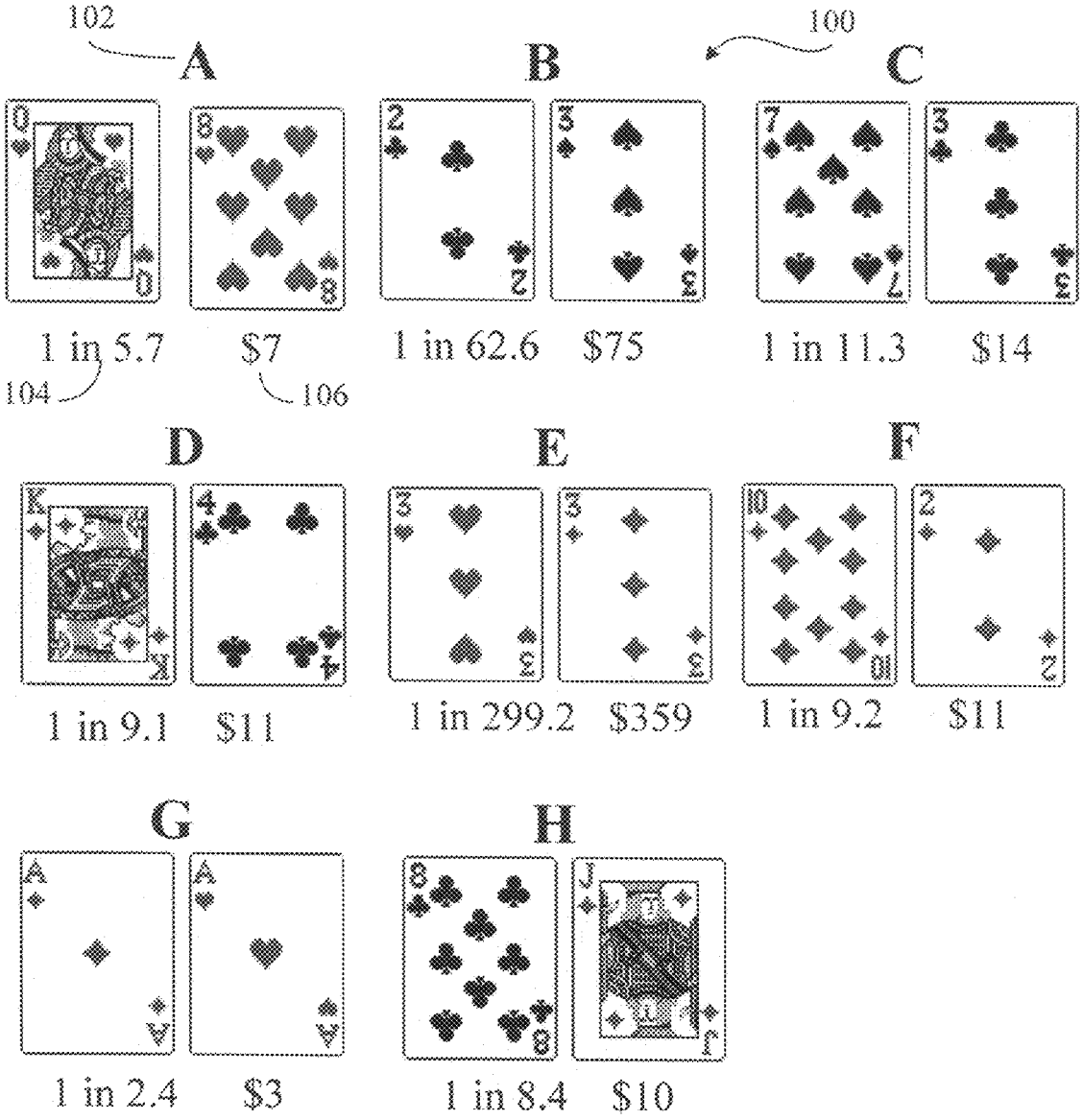
FIG. 1 depicts an initial display for a Hold'em Poker game.

FIG. 1 shows a display 100 for the initial stage of a Texas Hold'em Poker game. The display 100 includes a plurality of entries in a game, each entry consisting of two playing cards, or game elements, from a standard deck. Each entry is labeled with indicia 102, and the letters of the alphabet are used in this example. Various embodiments exist for determining the initial set of hands from which the player makes his selection. In one embodiment, the initial set of hands may be determined as if the set is dealt from a randomly ordered physical deck, as in a real game. In an alternative embodiment, the initial set of hands may be selected from a pool of sets of hands. Such a pool would consist of sets of non-overlapping hands that have desirable characteristics, such as an appealing range of odds and accompanying prizes. Such a pool may be cycled through or each selection chosen at random. In yet another embodiment, the same set of initial hands may be used for all instances of the game.

When displaying these cards, in one embodiment, the cards will have first appeared on screen with the back of the card displayed, with the value of each of the three cards then being revealed one by one. In another embodiment, the value of each card is apparent when it first appears on screen. Each entry of two cards has associated with it the odds 104 that the hand will win the game and a prize amount 106. The prizes are set so that the mathematical expectations of the prize payouts 106 for the hands are as close to each other or some fixed percentage as possible given the minimum increment of the prize amounts. For example, in FIG. 1, the prizes assigned to each hand are such that each prize amount 106 is an even dollar amount and the overall return for each bet is close to 60% within approximately 2%.

Figure 2:
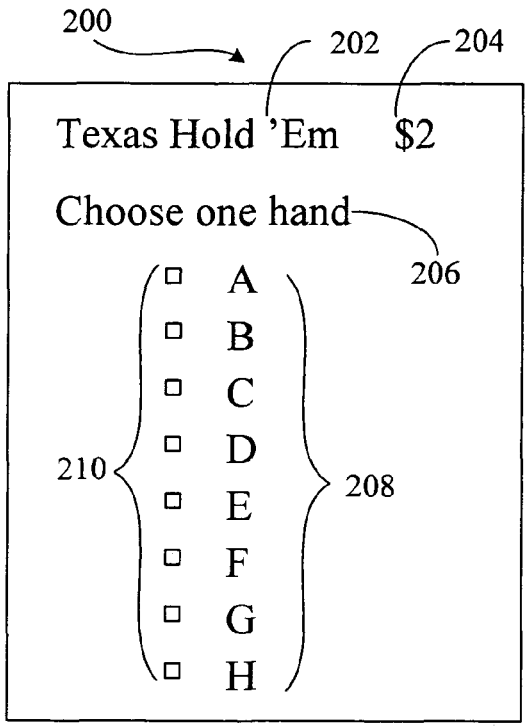
FIG. 2 illustrates a play slip used to make wagers in the Hold'em Poker game.
Figure 3:
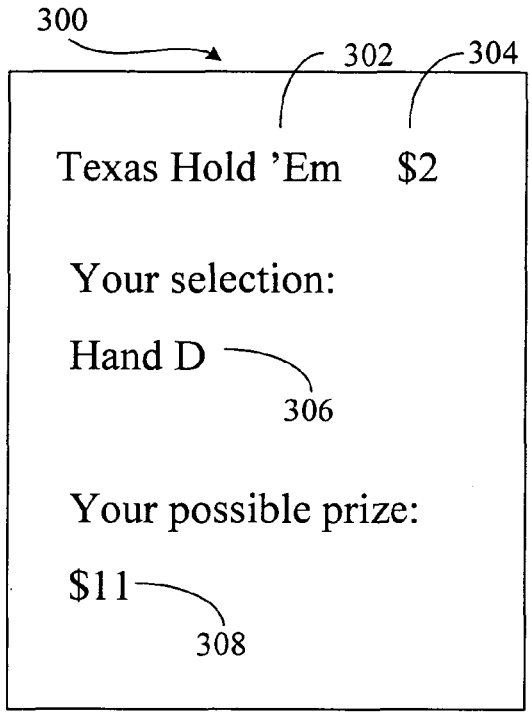
FIG. 3 illustrates a ticket for the Hold'em Poker game.

FIG. 2 shows a play slip 200 that may be used to make wagers in a Hold'em game. The play slip 200 includes the name of the game 202, the cost of the wager 204, instructions for the player 206, a set of indicia 208 corresponding to the indicia on the video display 100 described above, and areas 210 where the player may indicate his selection. After the player marks his selection on the play slip 200, he gives it to a lottery retailer, who will scan the ticket on a computer terminal, thereby registering the wager with a central control system. After the wager has been recorded, the central system will cause the terminal to issue a ticket 300, shown in FIG. 3, to the player, the ticket 300 indicating the name of the game 302, the cost of the wager 304, the player's selection 306, and the prize to be awarded 308 if the player's selection is among the winning hands.

Figure 4:
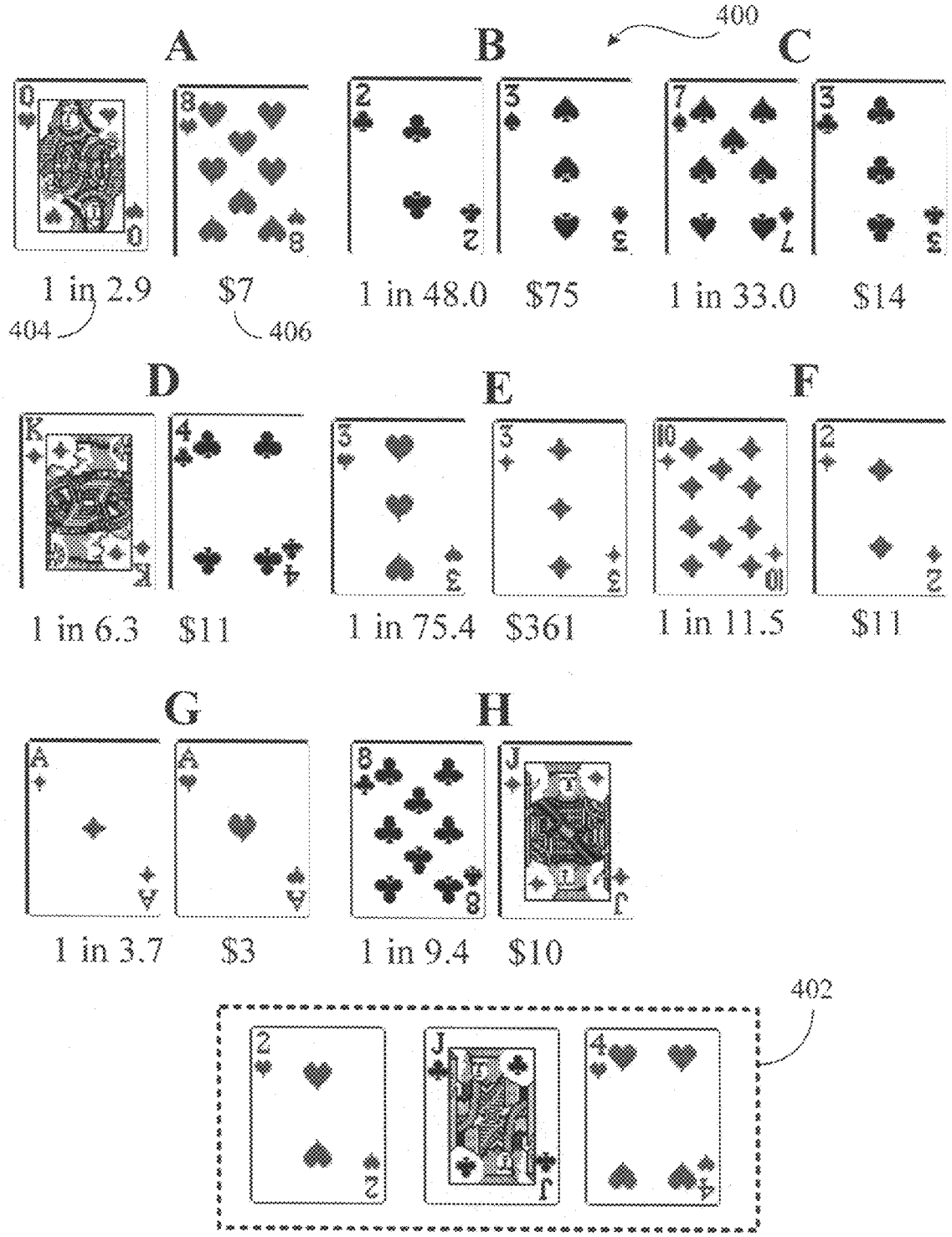
FIG. 4 illustrates the video display after three community cards have been revealed.

FIG. 4 shows a video display 400 after three of five community cards 402 have been revealed. There are varying embodiments for determining the set of community cards. In one embodiment the community cards may be determined as if dealt from a randomly ordered deck, as in a real game. After the community cards 402 are displayed, the odds 404 and prizes 406 associated with each hand may be updated to reflect the chances of each hand. In this case, the odds displayed to the player may represent the actual probabilities of the various hands winning, as if the game were being played with a physical deck. In another embodiment, the set of community cards may be determined by a probability distribution, in which case the actual set of cards could be selected by a random number generator. For each initial set of hands there could be a probability distribution on the sets of community cards. In this case, the odds 404 assigned the initial hands would be derived from the probability distribution. For example, the odds assigned to a hand could be the sum of the probabilities for sets of community cards in the distribution that make the hand a winner. It is understood that these methods could be embodied in stages or in combination. For example, it could be such that the first three community cards ("the flop") 402 could be determined by a probability distribution and the remaining two cards ("the turn" and "the river") could be determined as if dealt from a randomly ordered deck.

Figure 5:
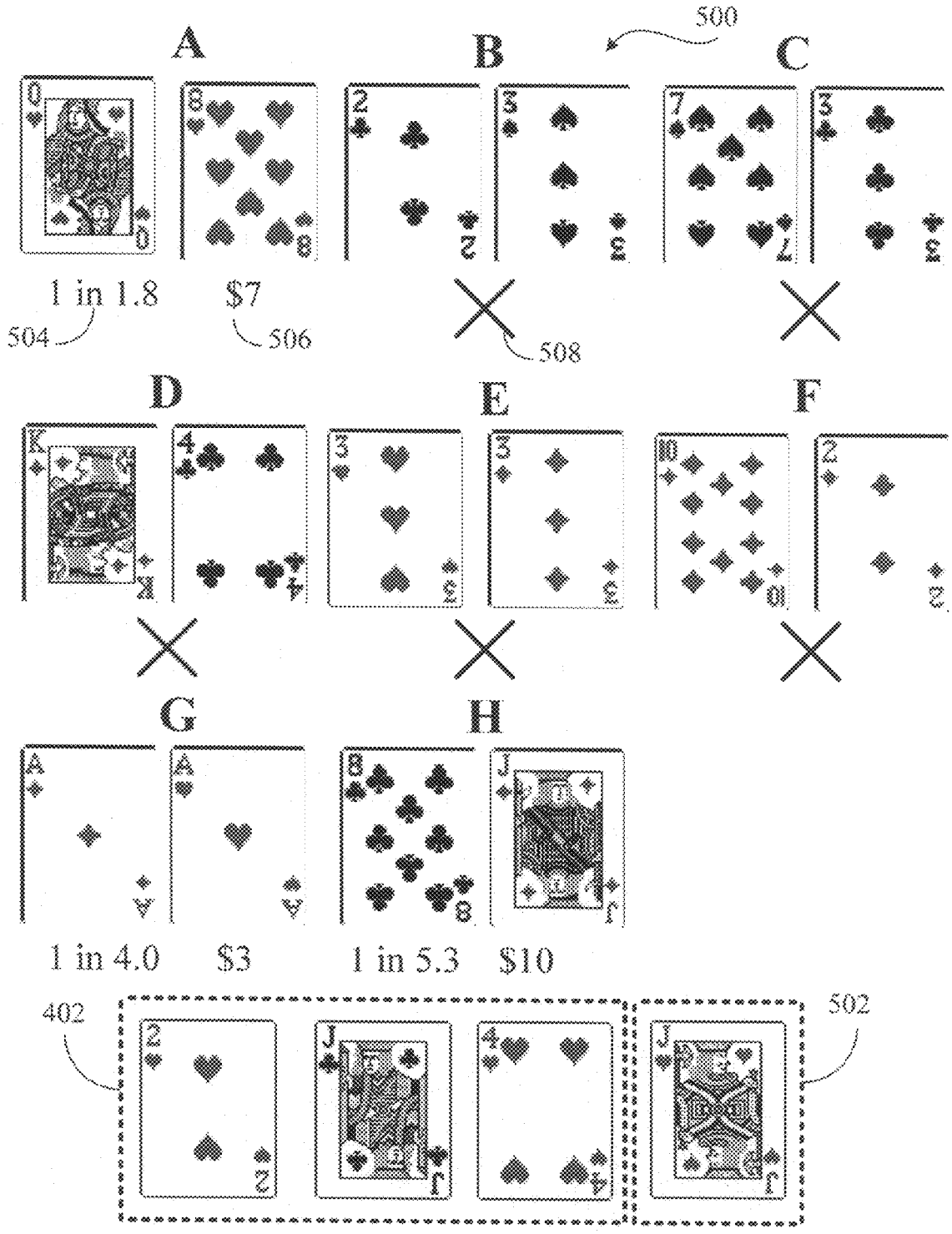
FIG. 5 illustrates the video display after the fourth community card has been revealed.

FIG. 5 shows the video display 500 after the fourth community card 502, also known as "the turn," has been revealed. The odds 504 displayed may be adjusted to reflect the probabilities of the various hands winning, which may have changed due to the values of all four community cards that have been revealed. In this case, the odds 504 might no longer be displayed for any hand, such as hands B-F that cannot possibly win. Alternatively, the original odds may continue to be displayed. In yet another embodiment, a non-winning indication 508 may be associated with each non-winning hand.

Figure 6:
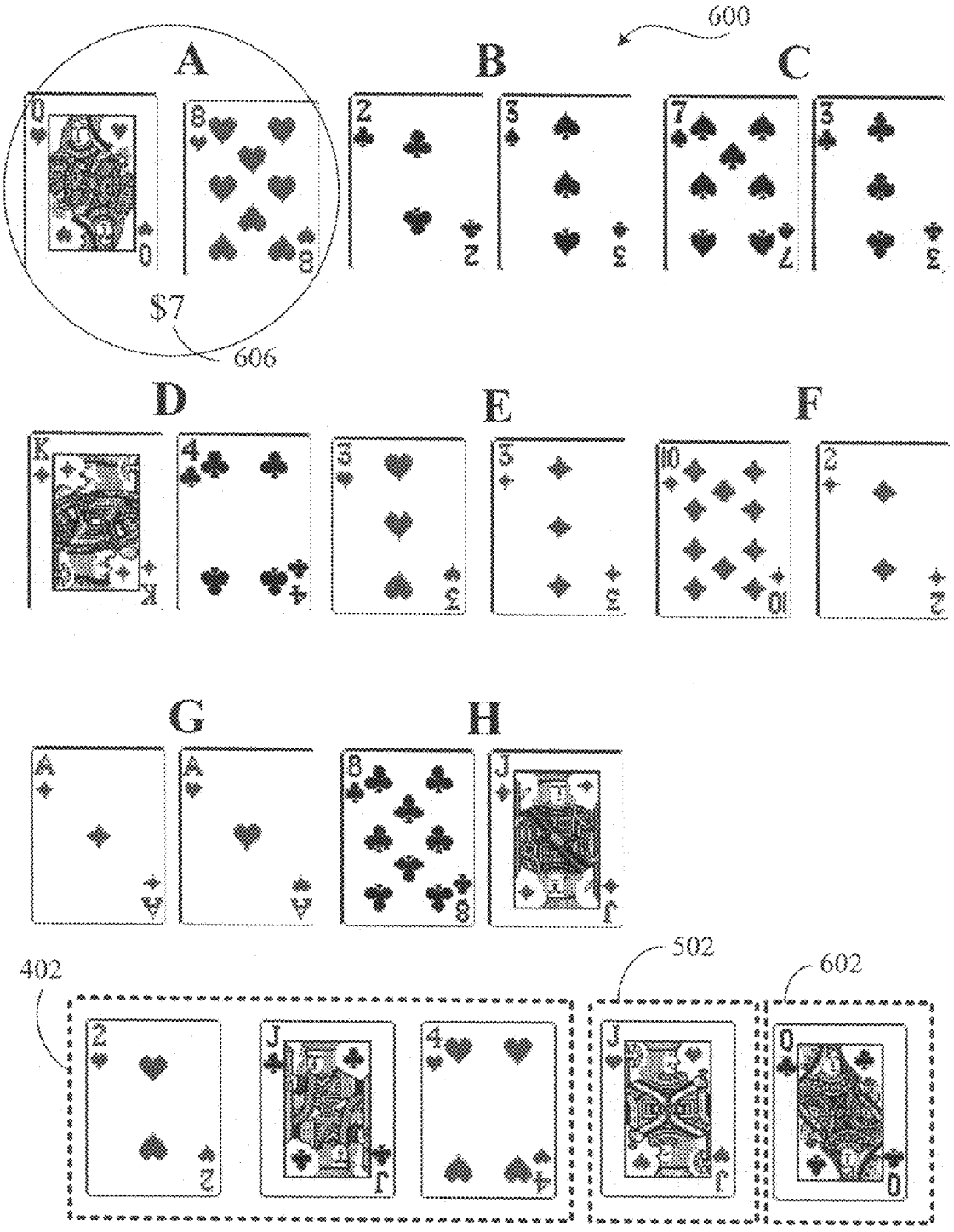
FIG. 6 is an example of the display at the end of the game.

FIG. 6 shows the video monitor display 600 at the end of the game. At this point the last community card, "the river," 602 is revealed. The monitor no longer displays any odds, and it displays prize amount 606 for only the winning hand or hands. It may also display an indication of which hands are the winning hands and a verbal description of the outcome.

In the embodiment discussed above the odds of an entry winning may be displayed at three stages of the game: (1) before any community cards have been disclosed, at which point the players make their wagers, (2) after three community cards have been disclosed, and (3) after 4 community cards have been disclosed. We discuss how these odds are calculated. For example, consider hand A in FIG. 1 that comprises the queen of hearts and 8 of hearts. There are 376,992 (36 choose 5) equally likely possible combinations for the community cards. Using a computer program, 65,634 of these combinations are identified that result in Hand A being a winner. Thus, the odds that hand A will win is 376,992/65,634=5.7, for which the inverse is 5.7. In FIG. 4, three community cards have been disclosed. There are 528 (33 choose 2) equally likely possible combinations for the remaining 2 community cards. Using a computer program, 182 can be identified that result in hand A being a winner. Thus, at this stage of the game the odds that hand A will win are 528/182=2.9. In FIG. 5, four community cards have been displayed. There are 32 remaining cards. Using a computer program, 18 are identified that result in hand A being a winner. Thus, at this stage of the game the odds that hand A will result in a winner are 32/18=1.8.

It should be observed that the discussed embodiments may not preclude the occurrence of multiple winners. The issue of "ties" can be handled in various ways. In one embodiment, the odds and prize values are based under the assumption that players who wager on a given hand will win that amount if that hand is among the winning hands for that game, whether the hand is the sole winner or a joint winner. That is, a player receives the same prize regardless of how many winners there are. In another embodiment, the prizes are set under the assumption that players who wager on a given hand will win that amount only if that hand is the sole winner and that players who wager on the hand will win a smaller amount if that hand is among the winning hands but is not the sole winning hand. For example, each winner could win some fraction of the prize he would have won had he been the sole winner. It is also possible to prevent ties altogether. For each set of initial hands, a probability distribution of sets of community cards could be contrived so that no ties exist in the universe of possible outcomes.

Those of ordinary skill in the art will recognize that any number of prize structures for this game can be derived by varying the number of hands played, the pool of sets of initial hands, the probability distribution on the pool of sets of initial hands, the sets of community cards, the probability distribution on the sets of community cards, and the mathematical expectation of the total prize payout.

Figure 7:
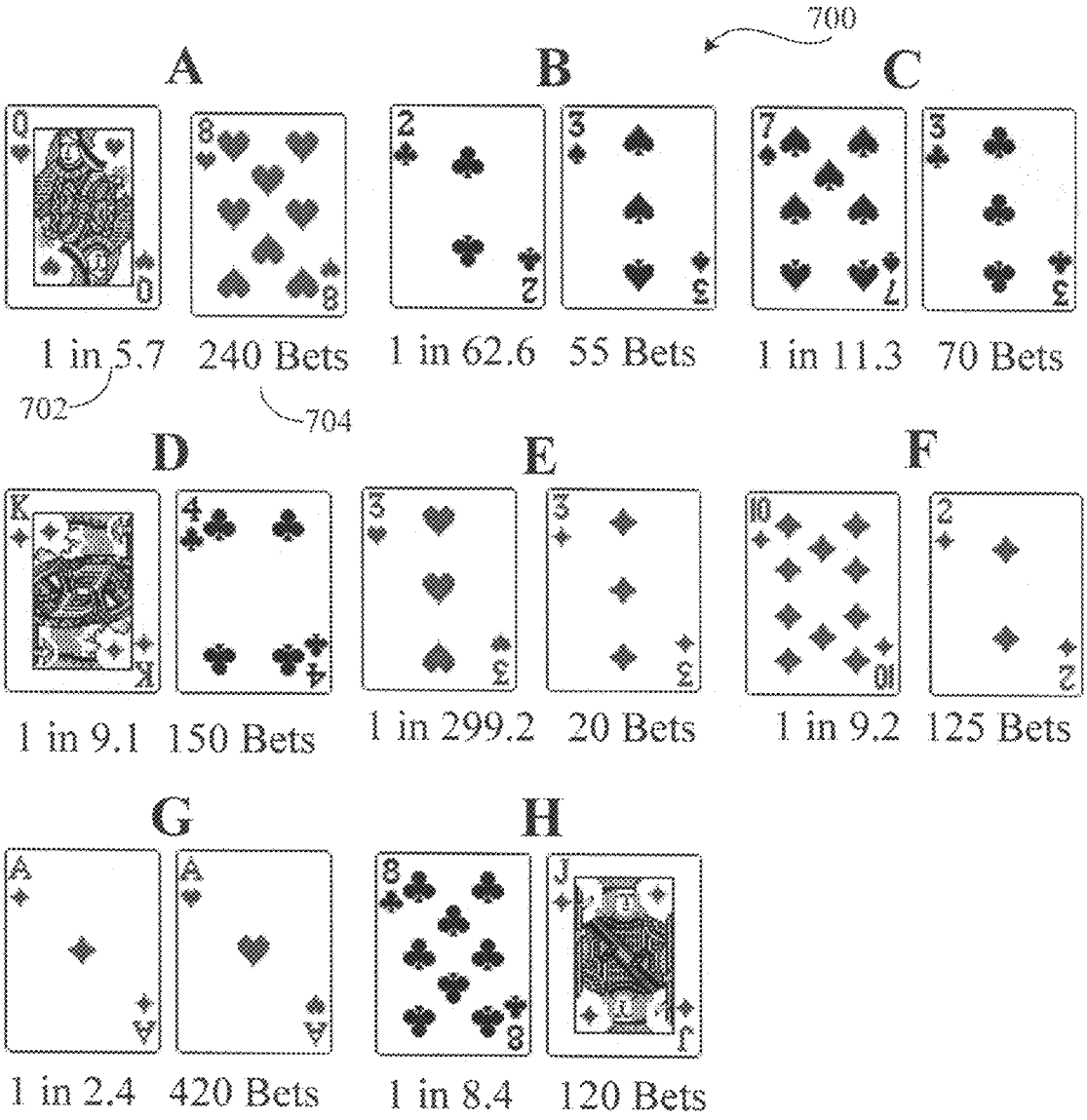
FIG. 7 is an alternative initial display for the invention.
Figure 8:
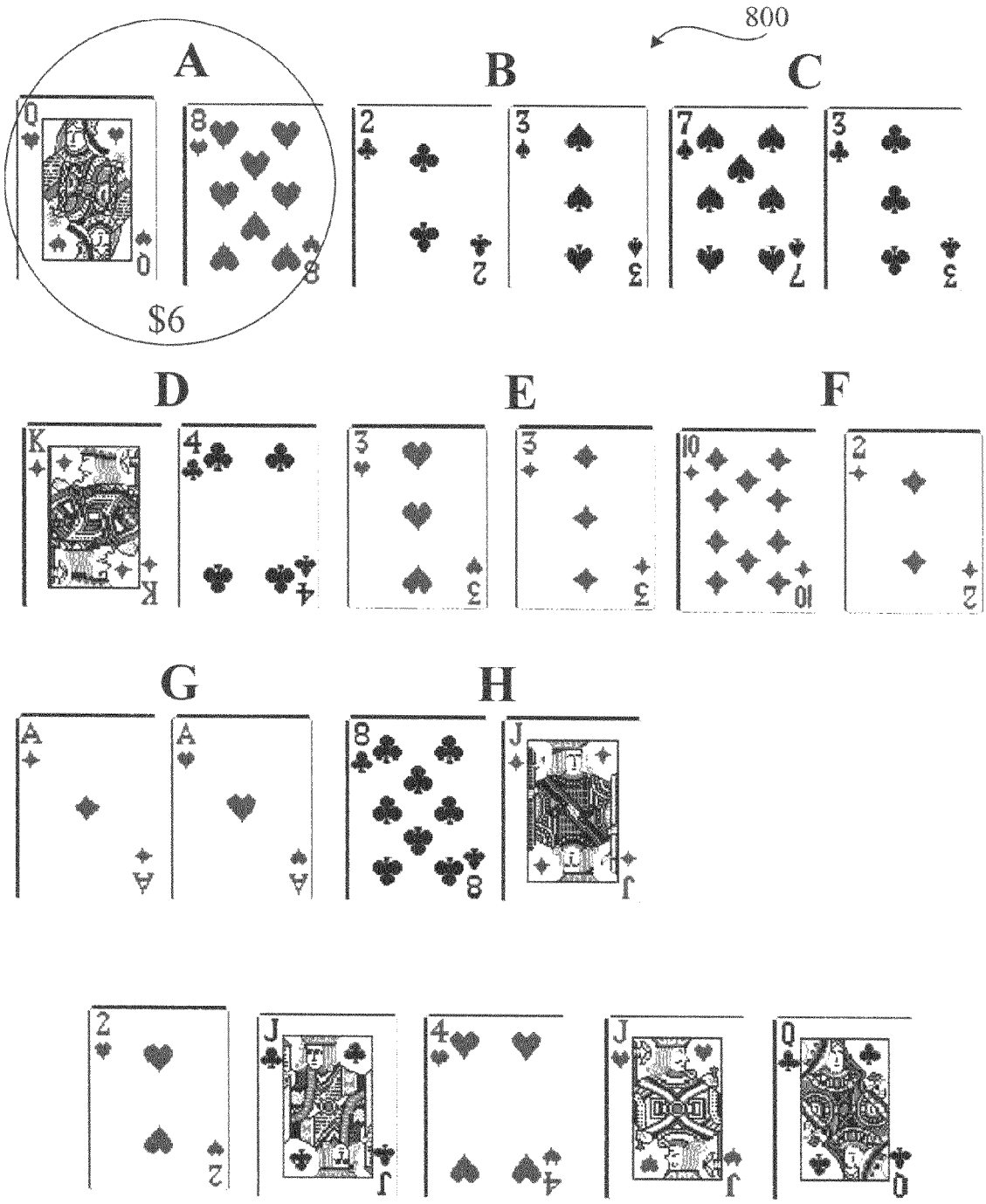
FIG. 8 illustrates the final display with a payout for the winning hand.

In a fundamentally different embodiment, the prize amounts may be determined not by the probability distribution but rather by the relative amounts wagered in total on each of the hands according to a pari-mutuel scheme as shown in FIG. 7. In this embodiment, the prizes 704 may be displayed dynamically as wagers are made, or they may be displayed only after the window for placing wagers has closed, or they may be displayed only at the end of the game and only for the winning hand or hands. The monitor may display information on the number of bets that have been placed on each opening hand. For example, the odds 702 for the initial hands are displayed along with the number of tickets, or "bets," for each hand. Suppose that a total 1200 tickets each costing $2 were purchased. As indicated in FIG. 7, suppose that 240 of those tickets selected Hand A as the winner. If A wins, as in FIG. 8, and the payout is to be 60%, then the pari-mutuel prize payout per winning ticket is (1,200×$2×0.6)/240=$6.

Figure 9:
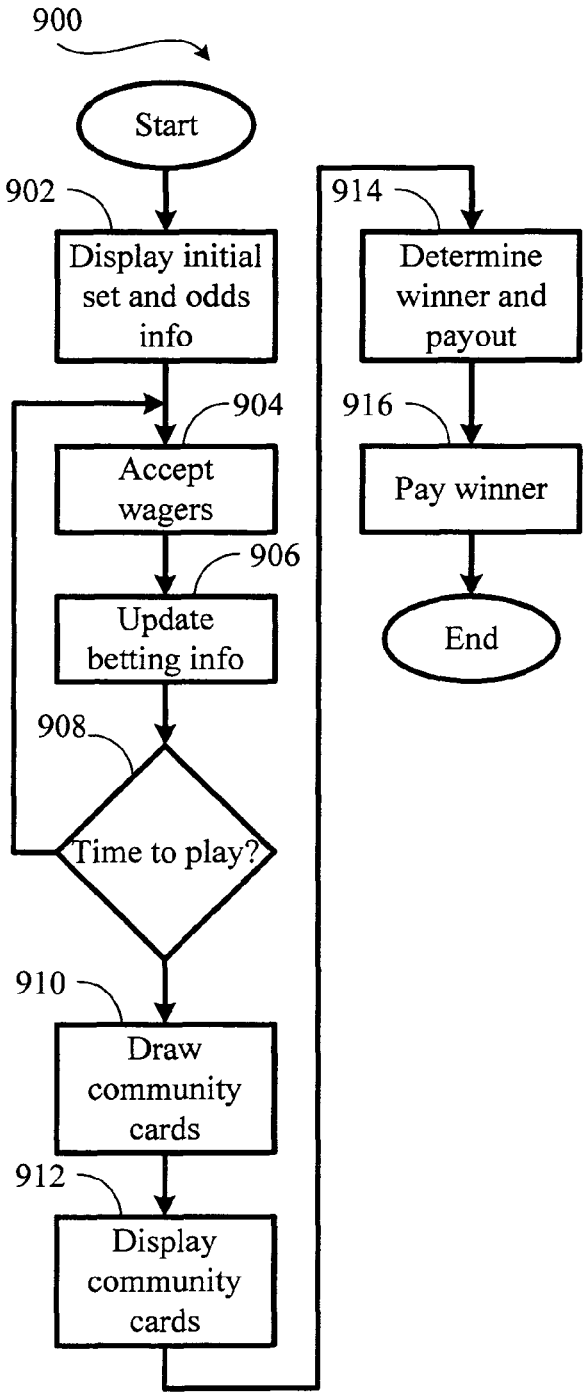
FIG. 9 is a flow chart for a multi-player Texas Hold'em Poker game.

FIG. 9 is a flow chart 900 for a multi-player Texas Hold'em Poker game executed on a server. The server generates an initial set of hands, calculates odds for each hand, and displays the initial set and the corresponding odds information to players, step 902. The display may be on multiple monitors connected directly to the server or connected to a client device that communicates with the server through a network. While the initial set is displayed, the server accepts wagers from the players, step 904. The wagers may be placed at different betting stations that are connected to the server. The wager information is transmitted through a network to the server for processing. The server may compute and update the betting information on the display, i.e., the server may update in real time how many bets are placed on each hand as described in FIG. 7. The betting information update may continue while as long as the time for placing bets has not expired and the players are still placing bets. After betting is closed, the server generates five community cards, step 910, and display them to the players, step 912. The generation and display of the community cards may be done in manner described above. After the community cards are drawn and displayed to the players, the server determines a wining hand, or winning hands, and a corresponding payout, step 914. Finally, the winner is paid, step 916.

Figure 10:
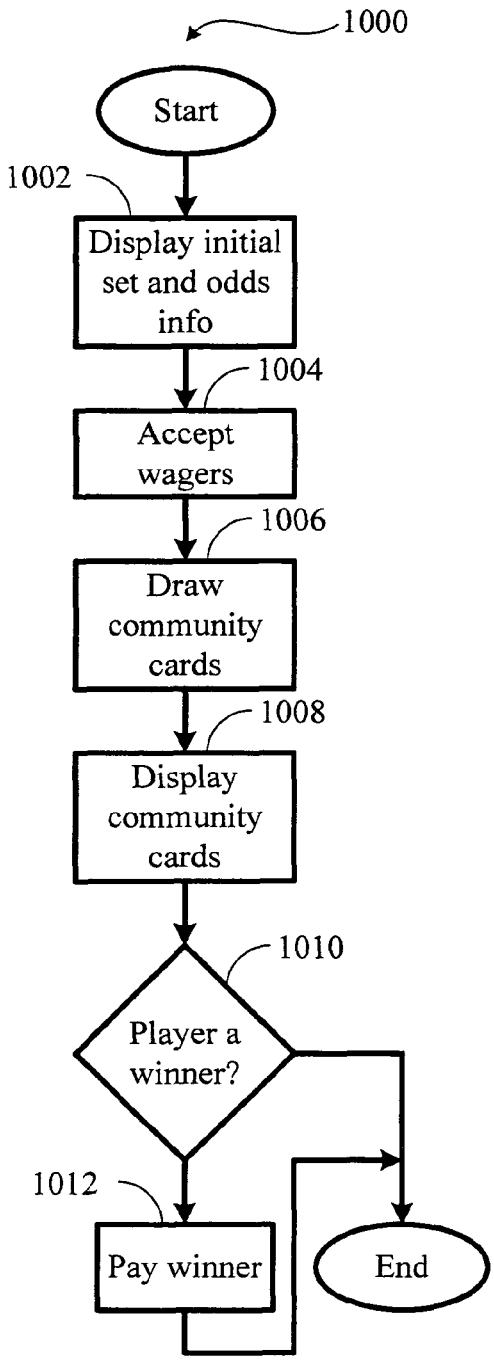
FIG. 10 is a flow chart for a single-player Texas Hold'em Poker game.

FIG. 10 is a flow chart 1000 for a single-player Texas Hold'em Poker game executed on a computing device. The computing device generates an initial set of hands, calculates odds for each hand, and displays the initial set and the corresponding odds information on a monitor to a player, step 1002. While the initial set is displayed, the computing device accepts a wager from the player, step 1004. After the player places a betting, the computing device generates five community cards, step 1006, and displays them to the player, step 1008. The generation and display of the community cards may be done in manner described above. After the community cards are drawn and displayed to the player, the computing device determines a wining hand, or winning hands, and checks whether the player has the winning hand, step 1010. If the player has a winning hand, the computing device pays the player, step 1012.

Figure 11:
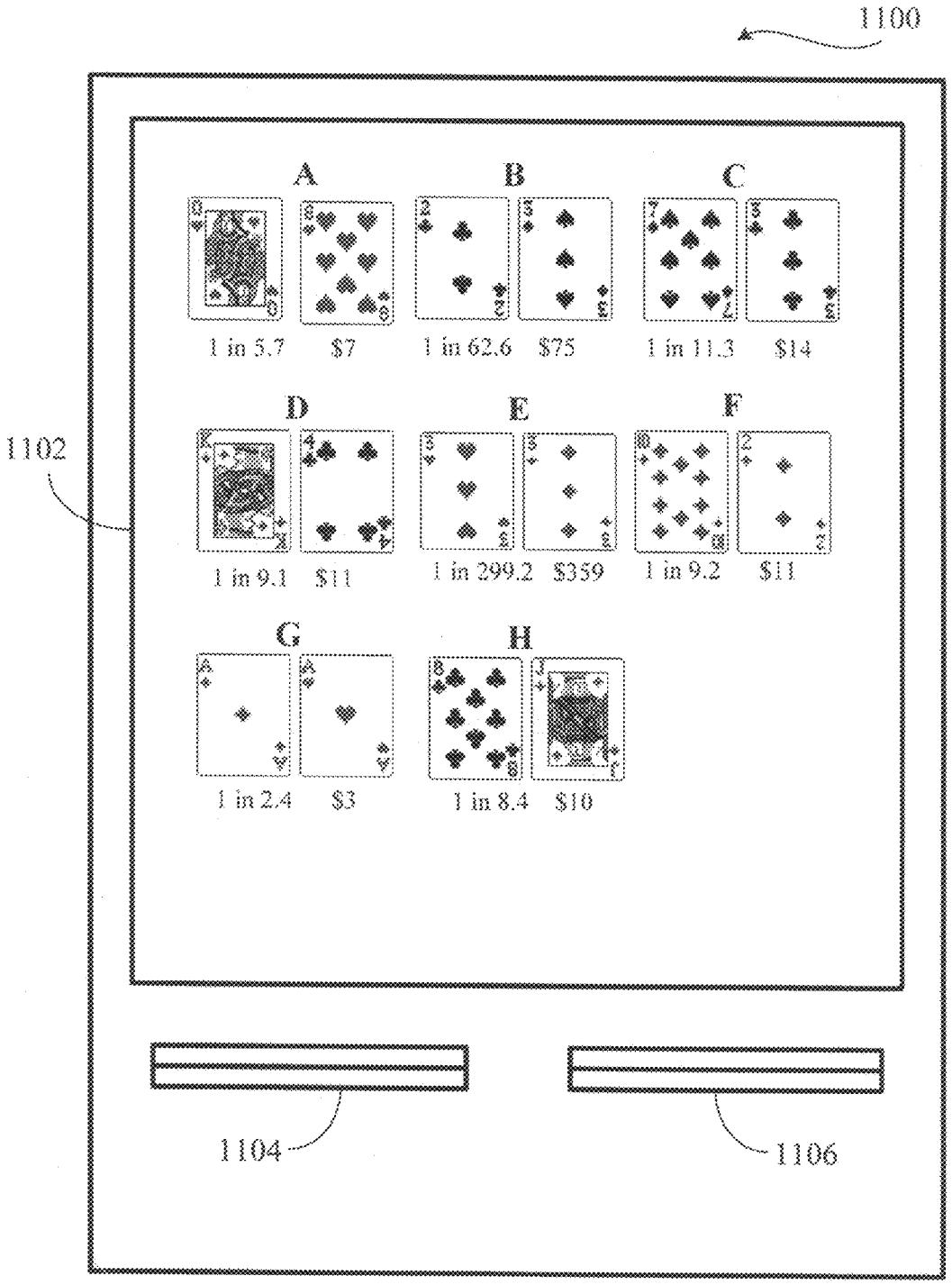
FIG. 11 illustrates a standalone gaming device.
Figure 12:
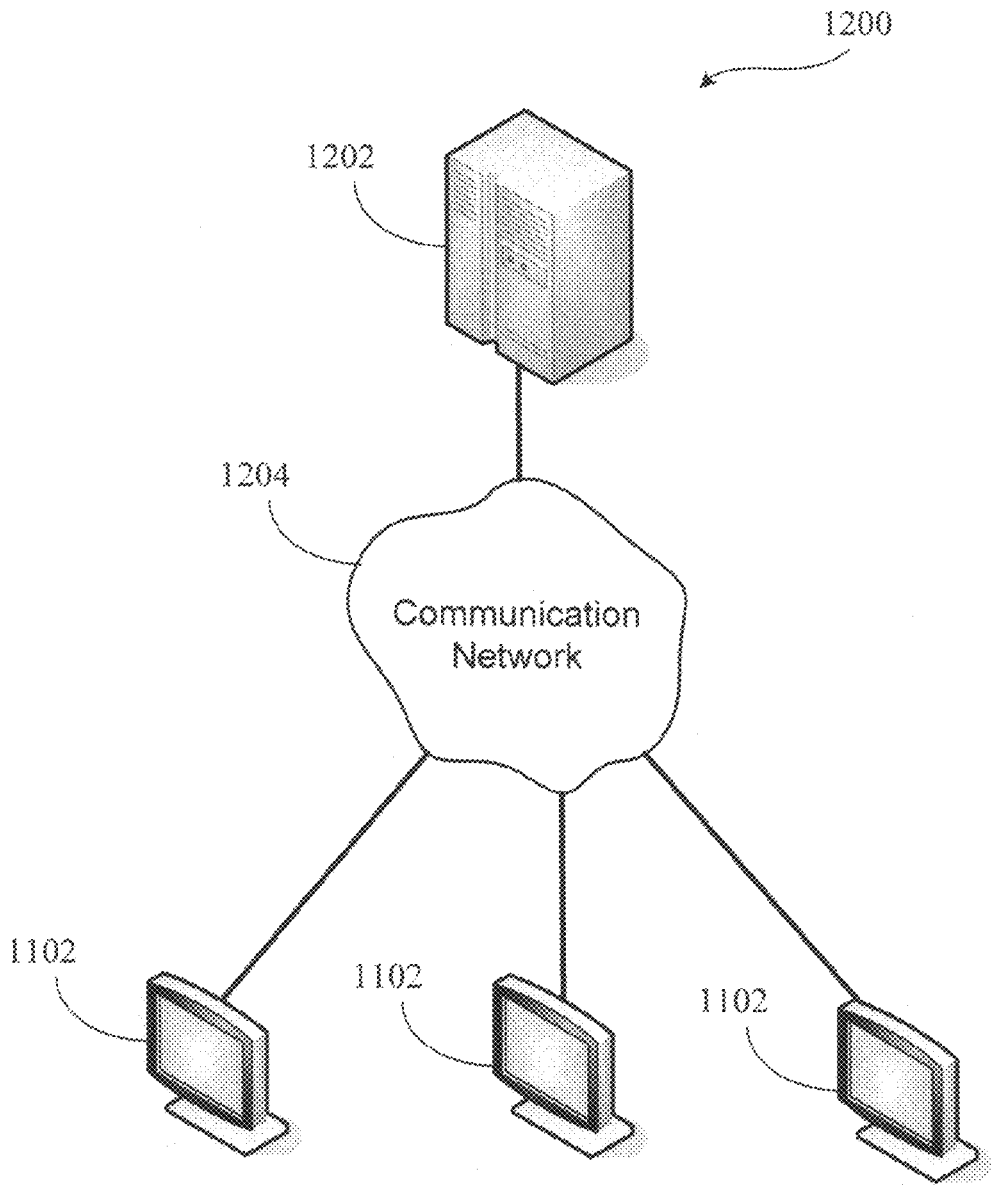
FIG. 12 illustrates a plurality of network-based gaming devices.

The invention can be based on a standalone gaming machine or a server. FIG. 11 illustrates a standalone gaming device 1100 used to support the invention. The gaming device 1100 includes a display unit 1102, a scanning unit 1104 (also known as a player input device) for scanning play slips, and a ticket issuing unit 1106 for issuing tickets to players. The gaming device 1100 has a controller that generates the initial set of entries and displays the initial set on the display unit 1102. The controller also takes player bets from the scanning device and issues a ticket to the player. After issuing the ticket, the controller generates gaming information, which includes a set of community cards, and determines if the player has a winning hand according to the predefined rules. The gaming device 1100 may also be connected to a server 1202 as illustrated in FIG. 12. The gaming device 1102 is connected to the server 1201 through a communication network 1204. In the embodiment illustrated in FIG. 12, each gaming device receives wagers from players, passes betting information to the server 1202, and displays the game information received from the server 1202.

In the context of FIGS. 9-10, the method may be implemented, for example, by operating a computer to execute a sequence of machine-readable instructions. The instructions can reside in various types of signal-bearing or data storage primary, secondary, or tertiary media. The media may comprise, for example, RAM (not shown) accessible by, or residing within, the components of the wireless network. Whether contained in RAM, a diskette, or other secondary storage media, the instructions may be stored on a variety of machine-readable data storage media, such as DASD storage (e.g., a conventional "hard drive" or a RAID array), magnetic tape, electronic read-only memory (e.g., ROM, EPROM, or EEPROM), flash memory cards, an optical storage device (e.g. CD-ROM, WORM, DVD, digital optical tape), paper "punch" cards, or other suitable data storage media including digital and analog transmission media.

While the invention has been particularly shown and described with reference to one embodiment thereof, it will be understood by those skilled in the art that various changes in form and detail may be made without departing from the spirit and scope of the present invention as set forth in the following claims. Though, the methods in FIGS. 9-10 are illustrated in sequential steps, those skilled in the art will appreciate the different sequences may also be used to implement the invention. Furthermore, although elements of the invention may be described or claimed in the singular, the plural is contemplated unless limitation to the singular is explicitly stated.

What is claimed is:

1. A method for playing a computer simulated virtual lottery game on a computing device wherein a player's hand in the game is composed of an entry selected by the player combined with game elements common to all of the players, comprising:

displaying to a player a plurality of entries to the virtual game, wherein each of the plurality of entries includes at least two game elements and each game element has a game value according to a game rule for the virtual game, the game value of the elements of all of the entries being displayed to the player, and each player's hand comprised of one of the entries and a set of common game elements;

displaying to the player an initial odds of winning for a hand having each of the respective game entries and a fixed prize amount awarded for each respective entry, wherein the prize amounts are inversely proportional to the initial odds of winning;

subsequent to the steps of displaying the plurality of entries and associated odds of winning to the player, receiving from the player an initial wager associated with at least one of the plurality of entries, the initial wager being the first instance of any type of fee or wager from the player for participation in the game;

after receiving the player's initial wager, displaying to the player the additional common game elements, whereby the value of the player's hand in the virtual game as compared to other hands is determined by the player's initial entry selection;

updating the odds of winning associated with each of the plurality of entries based on the addition of at least some of the common game elements while maintaining the prize amount associated with each of the plurality of entries fixed;

determining a winning entry from the plurality of entries in combination with the common game elements according to a predefined rule; and awarding to the player that wagered on the winning entry the prize amount assigned to the winning entry.

2. The method of claim 1, wherein displaying to the player the common game elements comprises displaying to the player a set of three game elements and displaying to the player an additional set of two game elements.

3. The method of claim 2, further comprising updating the odds of winning associated with each of the plurality of entries after displaying to the player the set of three game elements.

4. The method of claim 2, wherein displaying to the player the set of two game elements further comprises displaying one game element at a time.

5. The method of claim 1, further comprising issuing a ticket to the player with an indication of the wager associated with at least one of the plurality of entries.

6. The method of claim 1, further comprising displaying to the player a non-winning indication associated with a non-winning entry.

7. The method of claim 1, wherein the lottery game is a simulated Texas Hold'em Poker game and the predefined rule is associated with a Texas Hold'em Poker game.

8. An apparatus for playing a computer simulated virtual lottery game wherein a player's hand in the lottery game is composed of a set common game elements combined with an entry selected by the player, comprising:

a controller;

a display device in communication with the controller, wherein the display device is configured to display to a player a plurality of entries, each of the plurality of entries includes at least two game elements, each game element having a displayed game value according to a game rule for the virtual game, and an initial odds of winning and fixed prize amount are displayed for each of the plurality of entries;

a player input device in communication with the controller, wherein the player input device is configured to receive an initial player bet from the player after the display device displays the entries and associated odds and fixed prize amounts for each respective entry, and communicate the initial player bet to the controller, the player bet being associated with at least one of the plurality of entries and being the first instance of any type of fee or wager from the player for participation in the game; and a ticket issuing device in communication with the controller, wherein the ticket issuing device is configured to receive information from the controller and issue a ticket to the player, wherein the display device is further configured to receive play information from the controller, display the play information to the player, and display the common game elements with updated odds of winning associated with each of the plurality of entries after receipt of the player's initial bet, whereby the value of the player's hand in the virtual game as compared to other hands is determined by the player's initial entry selection, and wherein the controller is configured to determine a winning entry from the plurality of entries according to a predefined rule.

9. The apparatus of claim 8, wherein the display device is further configured to display a set of three of the common game elements after the player bet is received from the player, and to update and display the odds of winning for each of the entries as a function of the common game elements.

10. The apparatus of claim 8, wherein the display device is further configured to display to the player a non-winning indication associated with a non-winning entry.

11. The apparatus of claim 8, wherein the lottery game is a simulated Texas Hold'em Poker game and the predefined rule is associated with a Texas Hold'em Poker game.

12. A system for playing a computer simulated virtual lottery game wherein a player's hand in the lottery game is composed of an entry selected by the player combined with a set common game elements, comprising:

a communication network;

a gaming machine in communication with the communication network; and a server in communication with the gaming machine;

wherein the gaming machine is configured to:

receive game information from the server;

display to a player a plurality of game entries, each of the plurality of game entries includes at least two game elements, each game element having a displayed game value according to a game rule for the virtual game, and an initial odds of winning and a fixed prize amount are displayed for each of the plurality of entries, said server computing the prize amount as a function of an overall payout for the lottery game such that the prize amount is inversely proportional to the initial odds of winning;

receive from the player an initial player bet associated with at least one of the plurality of game entries after display of the entries and associated initial odds and prize amounts for each respective entry, the initial player bet being the first instance of any type of fee or wager from the player for participation in the game;

communicate the initial player bet to the server;

receive ticket information from the server;

issue a ticket to the player;

receive additional game elements from the server that are common to all of the game entries;

display the common game elements to the player after receipt of the player's initial bet, whereby the value of the player's hand in the virtual game as compared to other hands is determined by the player's initial entry selection;

update the odds of winning associated with each of the plurality of game entries as a function of at least some of the common game elements while maintaining the respective prize amounts for the plurality of prize amounts fixed; and receive winning information from the server, wherein the winning information is determined according to a predefined rule.

13. The system of claim 12, wherein the gaming machine is further configured to display a set of three common game elements after the player bet is received from the player and to update the odds of winning as a function of the three common game elements.

14. The system of claim 12, wherein the ticket includes the player bet associated with at least one of the plurality of game entries.

15. The system of claim 12, wherein the gaming machine is further configured to display a non-winning indication associated with a non-winning entry.

* * * * *